United States Patent [19]

Akita et al.

[11] 4,444,035

[45] Apr. 24, 1984

[54] STEEL PIPE ROLLING MILL

[75] Inventors: Shinji Akita; Masayuki Hatanaka, both of Yokohama; Akira Uemura, Nakamachi, all of Japan

[73] Assignee: Nippon Kokan Kabushiki Kaisha, Tokyo, Japan

[21] Appl. No.: 398,813

[22] Filed: Jul. 16, 1982

[30] Foreign Application Priority Data

Jul. 24, 1981 [JP] Japan ..... 56-115386

[51] Int. Cl.[3] ..... B21B 31/08

[52] U.S. Cl. ..... 72/100; 72/238

[58] Field of Search ..... 72/95, 100, 238, 239

[56] References Cited

U.S. PATENT DOCUMENTS 2,060,768 11/1936 Assel ..... 72/96
2,868,047 1/1959 Zublin ..... 72/238
3,842,638 10/1974 Schmitt et al. ..... 72/239
4,136,545 1/1979 Wilson ..... 72/238

FOREIGN PATENT DOCUMENTS 554018 4/1977 U.S.S.R. ..... 72/95

*Primary Examiner*—Lowell A. Larson
*Attorney, Agent, or Firm*—Michael N. Meller

[57] ABSTRACT

In a three-roll Assel mill capable of automatically and rapidly changing the rolls, rails are arranged on an inner housing mounted within each of a fixed housing and a rotary housing to be rotatable along the inner wall thereof, and cradles having rolls mounted therein are placed on the rails, whereby during roll changing the housing proper is shifted and the inner housings are rotated in such a manner that the rails provided on the inner housings are successively aligned with rails laid externally and the rolls are moved in or out of the rolling mill.

5 Claims, 3 Drawing Figures

STEEL PIPE ROLLING MILL

The present invention relates to steel pipe rolling mills of the skew or corss helical rolling type, and more particularly the invention relates to a roll changing apparatus for a three-roll Assel mill.

As is well known in the art, the Assel mill includes three rolls which are mounted within the mill housing at the equal spacing of 120° for rotation in the same direction and each of the rolls has its axis skewed at an angle of 10 to 15 degrees with respect to the pass line of a steel pipe to be rolled (hereinafter referred to as a steel pipe) and also its diameter increased considerably on the exit side as compared with the entry side for the steel pipe thereby effecting the rolling at the central roll portion.

With this type of three-roll Assel mill, a heated steel pipe is rolled by feeding it through the gap formed by the three rolls and it is necessary to change the rolls with new rolls at times due to the wear or damages caused by their use over a long period of time. In the past, the roll changing has been effected by preparing two housings each having a set of rolls mounted therein, lifting the housing which has been in use by an overhead crane and moving the same to a roll shop, and moving the housing having a new set of rolls mounted therein from the roll shop by the overhead crane and installing the same in place in the mill. However, this kind of roll changing method presents a number of problems that two housings must always be prepared with the resulting increase in the equipment cost, that the roll changing requires much labor and time and that the loss time due to the stoppage of the rolling operation is large. Moreover, it is impossible to use the overhead crane for any other operation during the housing changing operation.

With a view to overcoming the foregoing deficiencies in the prior art, it is the primary object of the present invention to provide an improved steel pipe rolling mill in which housings are rotated in such a manner that three rolls are successively moved out and transferred along rails and new rolls are moved in along the rails and mounted in place in the mill, thereby accomplishing the roll changing operation rapidly and automatically without using any overhead crane.

To accomplish the above and other equally important objects, in accordance with the present invention there is provided a three-roll Assel mill comprising three rolls mounted within a housing proper for rotation in the same direction to roll a steel pipe, in which an inner housing is rotatably mounted inside a fixed housing mounted in the housing proper and a rotary housing supported rotatably in the fixed housing, respectively, the rolls are mounted within the inner housings so as to be spaced equally and the cradles of each roll are placed on rails arranged on the inner housings, whereby the inner housings are rotated in a manner that the rails are successively aligned with transfer rails laid externally and the rolls are moved in and out along the transfer rails.

In accordance with another form of the invention there is provided a steel pipe rolling mill comprising three rolls mounted within a housing proper to rotate in the same direction and roll a steel pipe, in which an inner housing is rotatably mounted within each of a fixed housing mounted in the housing proper and a rotary housing rotatably supported within the fixed housing, the rolls are mounted within the inner housings so as to be spaced equally and the cradles of each roll are placed on rails arranged on the inner housings, whereby the inner housings are rotated in a manner that the rails are successively aligned with first transfer rails laid externally thereby taking the rolls from the inner housings and moving onto the first transfer rails, and then the housing proper is shifted such that the rails of the inner housings are successively aligned with second transfer rails thereby moving in and mounting new rolls in the inner housings while transferring the rolls moved onto the first transfer rails to a roll shop.

With the constructions described above, the present invention has remarkable effects over the conventional roll changing method in that only a single housing proper is required and moreover the rolls can be changed by small number of persons in a short period of time without using any overhead crane with a very small loss time.

The present invention will become more apparent from the following description taken in conjunction with the accompanying drawings, in which.

The present invention will now be described in greater detail with reference to the illustrated embodiment.

Figure 1:
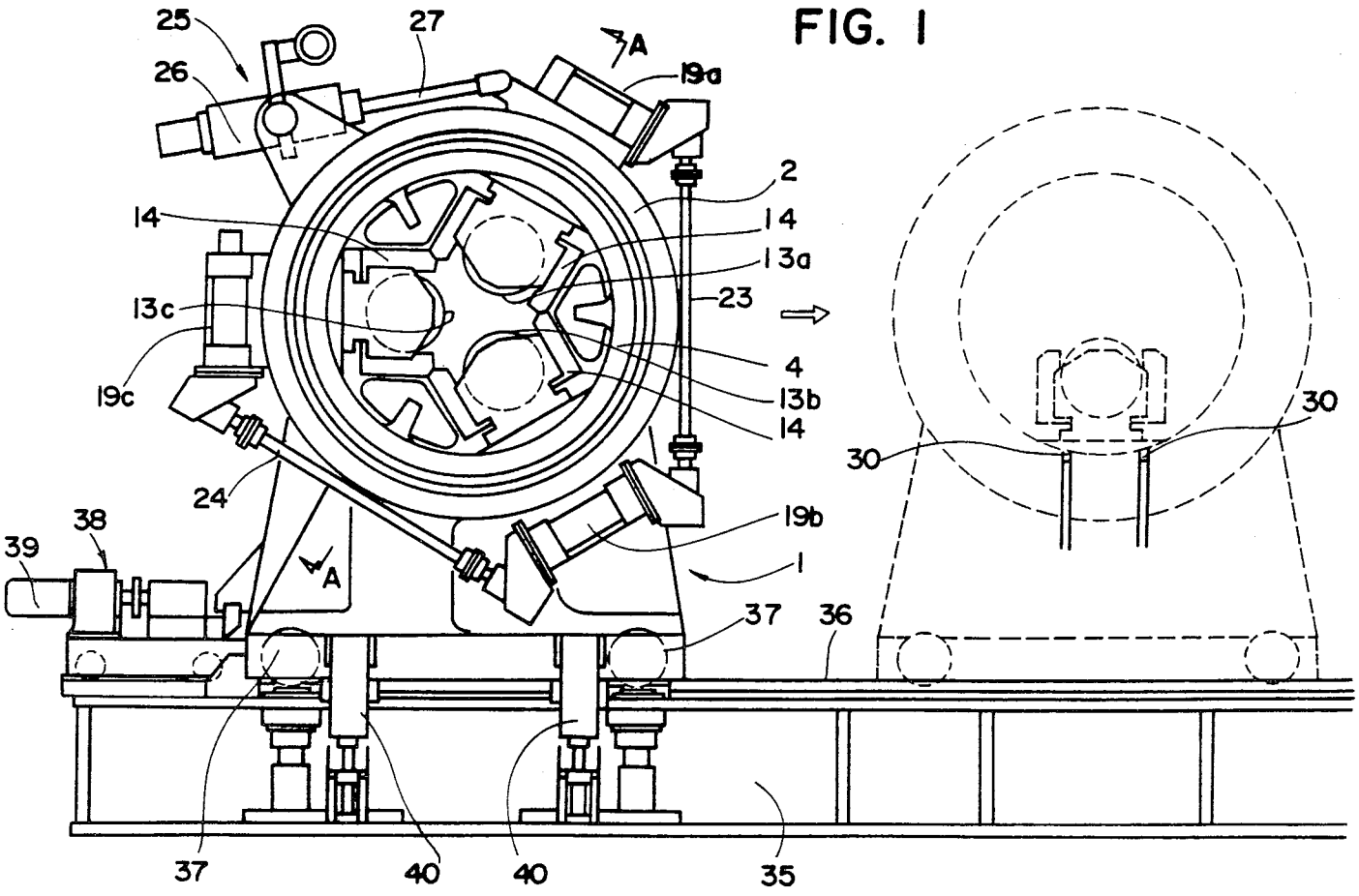
FIG. 1 is a front view of an embodiment of the present invention.
Figure 2:
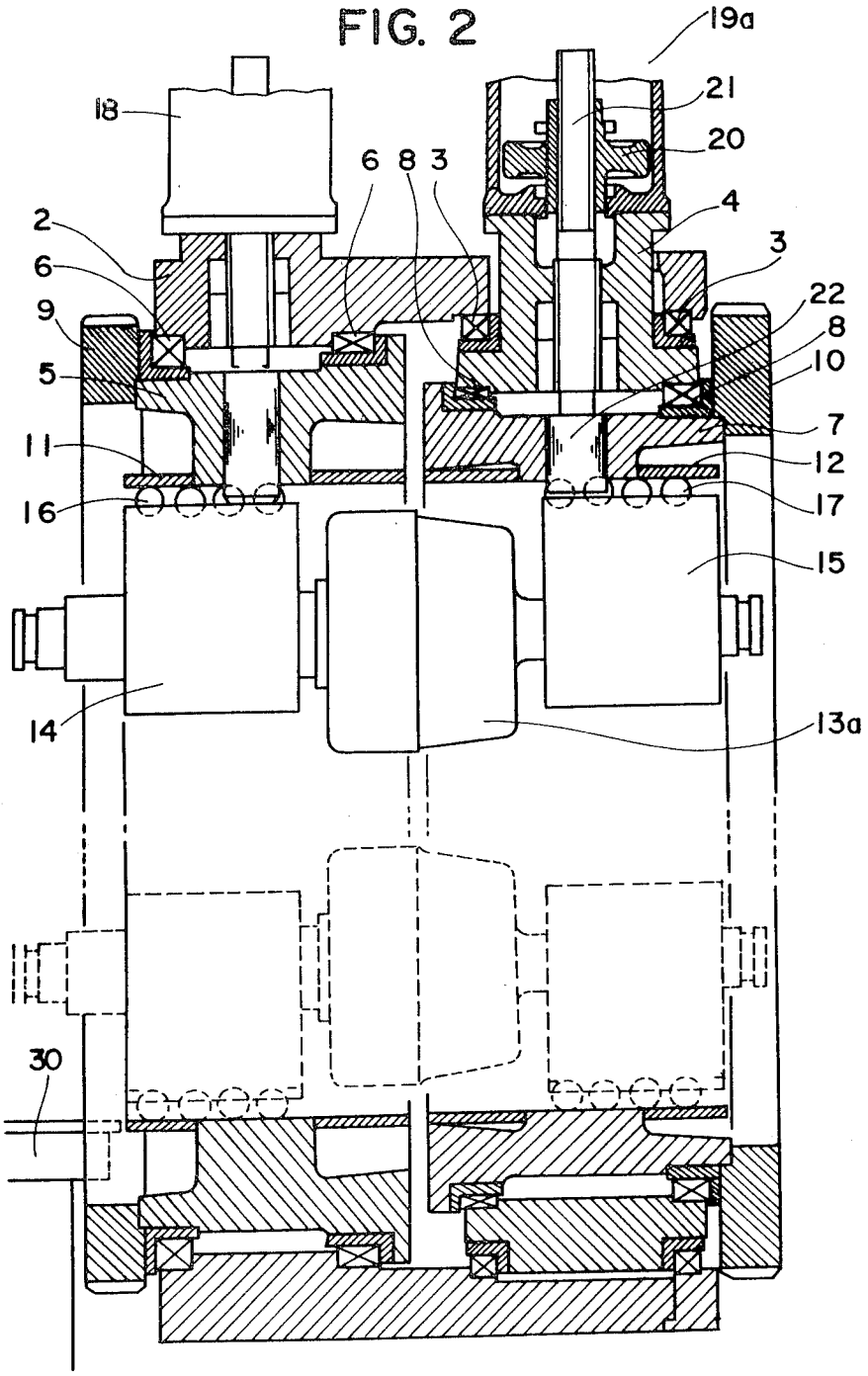
FIG. 2 is an enlarged sectional view taken along the line A—A of FIG. 1.

Referring to FIGS. 1 and 2, numeral 1 designates a housing proper including a fixed housing 2 in the upper part thereof and the fixed housing 2 rotatably supports a rotary housing 4 through bearings 3. Numeral 5 designates a first inner housing rotatably mounted within the fixed housing 2 through bearings 6, and 7 a second inner housing rotatably mounted within the rotary housing 4 through bearings 8. Gears 9 and 10 are respectively attached to one side of the inner housings 5 and 7. The gears 9 and 10 are adapted to rotate through a drive mechanism (not shown) the inner housings 5 and 7 along the inner surface of the fixed housing 2 and the rotary housing 4, respectively, in synchronism with each other. Numerals 11 and 12 designate rails arranged on the inner surface of the inner housings 5 and 7, respectively, in correspondence to the rolls.

Numerals 13*a*, 13*b* and 13*c* designate rolls supported by cradles 14 and 15 through chocks and arranged at the equal spacing of 120 ° within the inner housings 5 and 7. Numerals 16 and 17 designate wheels provided in two rows on the surface of the cradles 14 and 15 which face the inner housings 5 and 7, respectively, and are placed on the rails 11 and 12, respectively. Numeral 18 designates screw down devices provided on the fixed housing 2 in association with the cradles 14 of the rolls 13*a* to 13*c* (in FIG. 2 the screw down devices associated with the rolls 13*b* and 13*c* are not shown). Numerals 19*a*, 19*b* and 19*c* designate screw down devices provided on the rotary housing 4 in association with the cradles 15 of the rolls 13*a* to 13*c*. Note that in FIG. 1 only the screw down devices 19*a* to 19*c* provided on the rotary housing 4 are shown.

In the screw down device 19*a*, numeral 20 designates a gear driven and rotated from a driving source (not shown) comprising a motor or the like and numeral 21 designates an external thread engaged with the internal thread formed in the gear 20 and havings its forward end coupled to a spindle 22. As a result, when the gear 20 is rotated, the external thread 21 is displaced vertically and thus the spindle 22 is moved vertically. The screw down devices 19*b* nd 19*c* are all the same in construction with the screw down device 19*a*, and the rotation of the gear 20 of the screw down device 19*a* is transmitted to the screw down devices 19*b* and 19*c* by way of rods 23 and 24, respectively. Note that the screw down devices 18 on the fixed housing 2 are identical in construction and function with the screw down devices 19*a* to 19*c* and therefore will not be described. Numeral 25 designates a rotation mechanism attached to the fixed housing 2, in which an operating rod 27 of a hydraulic cylinder 26 is coupled to the screw down device 19*a* so that the operation of the hydraulic cylinder 26 causes the rotary housing 4 to rotate along the inner surface of the fixed housing 2 thus making a so-called rotation.

Numeral 30 designates a pair of transfer rails arranged at a position some distance apart from the rolling mill (e.g., the broken line position in FIG. 1) and extended substantially in the same direction as the pass line of the steel pipe at the same height and the same spacing with the rails 11 and 12 when the inner housings 5 and 7 are rotated thereby bringing the rails 11 and 12 to their lowermost positions. Numeral 35 designates a base with rails 36 on which are placed wheels 37 provided on the lower part of the housing proper 1. Numeral 38 designates a transfer car placed on the rails 36 and coupled to the housing proper 1 so that by operating a motor 39, it is possible to move the housing proper 1 along the rails 36. Numeral 40 designates locking devices for locking the housing proper 1 to the base 35.

With the rolling mill of this invention constructed as above described, the roll changing procedure is as follows.

(1) The spindles 22 of the screw down devices 18 and 19*a* to 19*c* are moved upward and the inner housings 5 and 7 are set free.

(2) The rotary housing 4 is rotated reducing the rotation angle to zero.

(3) The locking devices 40 are released and the housing proper 1 is moved by the transfer car 38 thereby shifting and locking the housing proper 1 at the broken line position of FIG. 1.

(4) The inner housings 5 and 7 are rotated for example in a clockwise direction through the gears 9 and 10 and one of the three rolls (e.g., the roll 13*b*) is positioned just below the steel pipe pass line. In this case, the rails 11 and 12 provided on the inner housings 5 and 7 are aligned with the rails 30 arranged externally.

(5) The roll 13*b* is moved out along the transfer rails 30.

(6) The inner housings 5 and 7 are rotated further so that the next roll (e.g., the roll 13*a*) is moved to the outside and then the inner housings 5 and 7 are rotated further thereby moving out the final roll (e.g., the roll 13*c*).

Figure 3:
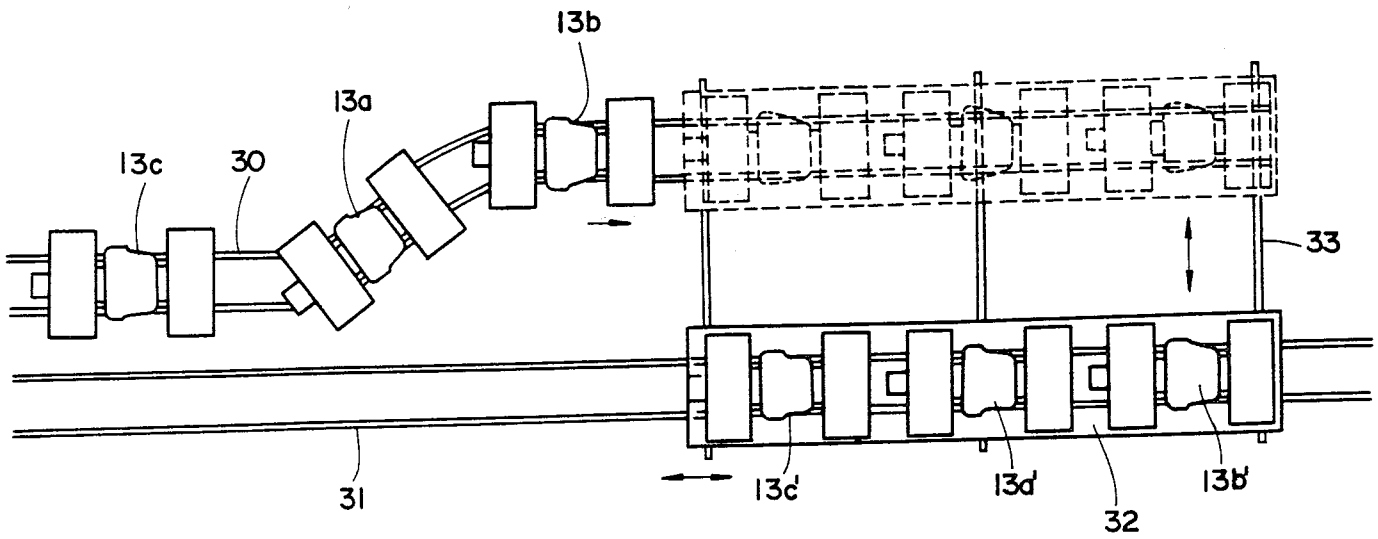
FIG. 3 is a plane view of an embodiment of transfer rails according to the invention showing the rolls moved out of the housings and the rolls to be moved into the housings.

(7) The rolls 13*b*, 13*a* and 13*c* thus moved out of the inner housings 5 and 7 are placed on the transfer rails 30 as shown in FIG. 3. On the othe hand, second transfer rails 31 are arranged parallel to the first transfer rails 30 and new rolls 13*c*, 13*a*′ and 13*b*′ set up in the roll shop are standing by on a carriage 32 placed on the rails 31.

(8) The housing proper 1 is shifted to and locked at the position of the second transfer rails 31.

(9) The new rolls 13*c*′, 13*a*′ and 13*b*′ are successively moved into the inner housings 5 and 7 are mounted in the inner housings 5 and 7 by the steps reverse to those mentioned previously.

(10) The housing proper 1 is moved back into the initial position and it is then locked to the base 35 by the locking devices 40.

The changing of the rolls is now completed. On the other hand, after the new rolls 13*c*′, 13*a*′ and 13*b*′ have been mounted in place in the inner housings 5 and 7, the empty carriage 32 is moved transversely and aligned with the transfer rails 30 so that the rolls 13*c*, 13*a* and 13*b* moved out of the inner housings 5 and 7 are placed on the carriage 32 and the carriage 32 is moved again transversely and transferred along the second transfer rails 31 to the rolls shop thereby setting up the rolls again.

While, in the embodiment described above, the transfer rails 30 are positioned some distance apart from the housing proper 1, the rails 30 may be arranged at the position of the housing proper 1 during the rolling depending on the surrounding conditions. Further, while FIG. 3 shows an example of the rails for moving the rolls in and out of the inner housings 5 and 7, the present invention is not intended to be limited thereto and the same can be realized by various other means. Further, the fixed housing, the rotary housing, the inner housings, the screw down devices, etc., are not limited to the constructions and functions disclosed by the above-described embodiment and it is possible to use any other mechanisms having the equipvalent functions and effects.

We claim:

1. In a steel pipe rolling mill comprising a three-roll Assel mill having three rolls which are arranged within a housing proper and rotated in the same direction to roll a steel pipe to be rolled, the improvement wherein an inner housing is rotatably mounted within each of a fixed housing disposed in said housing proper and a rotary housing rotatably supported in said fixed housing, wherein said three rolls are mounted inside said inner housings at equal spaces, and wherein cradles of each of said rolls are placed on rails disposed on said inner housings, whereby said inner housings are rotated to successively align said rails with transfer rails laid externally and thereby move in or out said rolls along said transfer rails.

2. A steel pipe rolling mill according to claim 1, wherein said housing proper is adapted to be shifted along a base in a direction perpendicular to a pass line of said steel pipe to be rolled.

3. In a steel pipe rolling mill comprising a three-roll Assel mill having three rolls which are arranged within a housing proper and rotated in the same direction to roll a steel pipe to be rolled, the improvement wherein an inner housing is rotatably mounted within each of a fixed housing disposed in said housing proper and a rotary housing rotatably supported in said fixed housing, and wherein cradles of each of said rolls are placed on rails disposed on said inner housings, whereby said inner housings are rotated in such a manner that said rails are successively aligned with first transfer rails laid externally and said rolls are moved out of said inner housings and transferred onto said first transfer rails, and said housing proper is shifted in such a manner that said rails are successively aligned with second transfer rails to move in and mount new rails in said inner housings and said rolls transferred onto said first transfer rails are transferred to a roll shop.

4. A steel pipe rolling mill according to claim 1 or 3, wherein a plurality of wheels are provided on a low surface of each of said cradles and placed on said rails on associated one of said inner housings.

5. A steel pipe rolling mill according to claim 1 or 3, wherein a gear is attached to each of said inner housings, and wherein said gears are rotated in synchronism with each other by a driving source comprising a motor or the like.

* * * * *